US007306704B2

(12) United States Patent
Hyvönen

(10) Patent No.: US 7,306,704 B2
(45) Date of Patent: Dec. 11, 2007

(54) PRESS FELT

(75) Inventor: Kari Hyvönen, Tampere (FI)

(73) Assignee: Tamfelt Oyj ABP, Tampere (FI)

( * ) Notice: Subject to any disclaimer, the term of this patent is extended or adjusted under 35 U.S.C. 154(b) by 95 days.

(21) Appl. No.: 10/964,720

(22) Filed: Oct. 15, 2004

(65) Prior Publication Data

US 2005/0124248 A1 Jun. 9, 2005

Related U.S. Application Data

(63) Continuation of application No. PCT/FI03/00325, filed on Apr. 24, 2003.

(30) Foreign Application Priority Data

Apr. 26, 2002 (FI) ..... 20020804

(51) Int. Cl.
*D21F 7/08* (2006.01)

(52) U.S. Cl. ..... 162/358.2; 162/358.1; 162/900; 162/904; 28/110

(58) Field of Classification Search ..... 162/348, 162/116, 117, 199, 358.2, 900, 902, 903; 34/95; 139/383 A, 425 A; 28/110, 142; 427/407.1, 410, 412; 442/63, 79, 80, 91, 442/93, 118, 164, 168–171, 270, 271, 277, 442/281

See application file for complete search history.

(56) References Cited

U.S. PATENT DOCUMENTS 3,214,327 A * 10/1965 Wicker et al. ..... 162/205
4,119,753 A 10/1978 Smart
4,267,227 A * 5/1981 Schiher et al. ..... 442/275
4,439,481 A * 3/1984 Johnson et al. ..... 442/271
4,500,588 A * 2/1985 Lundstrom ..... 428/212
4,529,643 A * 7/1985 Lundstrom ..... 442/275
4,657,806 A 4/1987 Dutt
4,752,519 A 6/1988 Boyer et al.
4,772,504 A 9/1988 Andresen
4,976,821 A * 12/1990 Laapotti ..... 162/360.2
5,118,557 A * 6/1992 Barnewall ..... 442/223
5,298,124 A 3/1994 Eklund et al.
5,591,305 A * 1/1997 Cameron ..... 162/117
5,674,663 A * 10/1997 McFarland et al. ..... 430/320

(Continued)

FOREIGN PATENT DOCUMENTS

EP 1 127 976 A2 8/2001

(Continued)

OTHER PUBLICATIONS

JP 64-6192, Kuwamoto, et al., Jan. 1989, English translation.*

(Continued)

*Primary Examiner*—Eric Hug
(74) *Attorney, Agent, or Firm*—Oliff & Berridge, PLC

(57) ABSTRACT

A method of manufacturing a press felt, a press section, and a press felt. The press felt comprises a base structure (11), a batt fibre layer (12) being attached to a first, web-side surface (B) of the base structure. Further, the structure of the press felt is compacted by treating it with a polymer material at least on the side of the first felt surface (B). After the polymer treatment, the surface of the felt is ground smooth.

32 Claims, 5 Drawing Sheets

U.S. PATENT DOCUMENTS 6,027,615 A * 2/2000 Davenport et al. ..... 162/358.2

FOREIGN PATENT DOCUMENTS

| | | | |
|---|---|---|---|
| FI | 64959 | | 10/1983 |
| FI | 923803 | | 12/1993 |
| JP | U-60-88193 | | 6/1985 |
| JP | 64-6192 | * | 1/1989 |
| JP | 3-76892 | * | 4/1991 |
| JP | 06-57678 | | 3/1994 |
| JP | 2002-161492 A | | 6/2002 |
| WO | WO 99/41447 | | 8/1999 |
| WO | WO 99/61130 | * | 12/1999 |
| WO | WO 01/27387 | | 4/2001 |
| WO | WO 02/10510 A1 | | 2/2002 |
| WO | WO 02/053832 A1 | | 7/2002 |

OTHER PUBLICATIONS

English language translation of Japanese Office Action.

* cited by examiner

PRESS FELT

This application is a Continuation of International Application PCT/FI03/00325 filed Apr. 24, 2003 which designated the U.S. and was published under PCT Article 21(2) in English.

FIELD OF THE INVENTION

The invention relates to a press felt comprising at least a base structure having at least a first surface on the fibre-web side and an opposite second surface, and at least one batt fibre layer attached to at least the first surface of the base structure.

The invention further relates to a method of manufacturing a press felt, comprising forming a base structure having a first surface on the fibre-web side and an opposite second surface, and attaching at least one batt fibre layer to at least the side of the first surface of the base structure.

Still further, the invention relates to a press section of a paper machine having several successive press positions, each of the press positions comprising at least one press nip in which the fibre web to be dried is supported by means of at least one press felt.

In addition, the invention relates to a press felt with seams, comprising at least a base structure which is formed of longitudinal yarns and transverse yarns, and which base structure has a first surface on the fibre-web side and an opposite second surface; a first transverse jointing edge and a second transverse jointing edge of the base structure, which jointing edges have seam loops formed by the longitudinal yarns of the base structure for interconnecting the jointing edges; and at least one batt fibre layer attached to at least the first surface of the base structure.

BACKGROUND OF THE INVENTION

In the press section of a paper machine, water is removed from the fibre web with several successive press units prior to conveying the web to the actual drying section. Generally, there are one to four successive press units. From the viewpoint of the energy consumption of the paper machine, it is advantageous to remove as much water as possible as early as in the press section, so that there is less need to dry the fibre web in the drying section. Prior to the press section the solid matter content of the fibre web is typically about 15 to 25%, while after the water removal carried out in the press section the solid matter content may have increased to more than 50%. In the press section, the paper web is pressed in a press nip, which can be formed of two rolls pressed against each other, what is called a shoe press, or another press system. Usually, the press section contains a press felt which supports the fibre web and into which the water present in the web permeates at the pressing stage. The purpose of the press felt is to retain the water it has received and to carry the water with it after the pressing without allowing it to travel back to the fibre web. It has been observed that problems of present press felts include for instance slow startability and a short lifetime.

BRIEF DESCRIPTION OF THE INVENTION

An object of the present invention is to provide an improved press felt of a new type and a method of manufacturing it. Further, an object is to provide an improved solution for drying a fibre web in the press section of a paper machine, providing, at the same time, good water removal capability and good strength and surface properties for the web.

A press felt according to the invention is characterized in that at least the first-side surface of the press felt is treated with a polymer material for compacting the structure of the press felt and for additionally attaching the batt fibre layer; and that the structure of the press felt is porous for receiving water, the air permeability being at least 2 $m^3/m^2$min, 100 Pa.

A method according to the invention is characterized by treating at least the first surface of the press felt with a polymer material in such a way that the air permeability of the press felt is at least 2 $m^3/m^2$min, 100 Pa, whereby, after the treatment, the structure is more dense than before the treatment, yet comprising pores to receive water; and that a polymer treatment is used for additionally attaching the batt fibre layer to the base structure.

A press section according to the invention is characterized in that at least one press position is provided with a press felt impregnated with a polymer material; that the air permeability of the press felt treated with a polymer is at least 2 $m^3/m^2$min, 100 Pa; and that the press felt treated with the polymer is arranged to receive water from the fibre web during the pressing carried out in the press nip.

A press felt with seams according to the invention is characterized in that at least the first-side surface of the press felt is treated with a polymer material for compacting the structure of the press felt and for additionally attaching the batt fibre layer; and that the structure of the press felt is porous for receiving water, the air permeability being at least 2 $m^3/m^2$min, 100 Pa.

An essential idea of the invention is that at least one press nip in the press section of a paper machine comprises a press fabric, i.e. press felt, at least on one side of which there is a layer whose permeability is lower than the permeability of the felt base structure and batt fibre. The felt has been treated in such a way that the felt is still clearly permeable, in other words it receives water and participates in the water removal in the press section. In addition, the felt still has, despite the compacting treatment, a felt-like structure.

An advantage of the invention is that a smooth-surfaced felt can form a smooth surface for the fibre web as early as at the input end of the press section. Thus, the fibre web needs not be calendered at later stages by using great pressing force. When less pressing force is used than previously, the fibre web is compacted less, owing to which a fibre web of the same thickness that is supplied to the press section can have a lower basis weight. In this way, a significant amount of raw material is saved. Further, since the felt participates in the water removal, good water removal capability is achieved also in the press unit smoothing the surface of the fibre web, which results in high efficiency in the whole press section.

An essential idea of an embodiment of the invention is forming a coating on at least one surface side of the press felt or a filling extending partly inside the press felt or at least to the side of one of its surfaces. The felt can be treated by, for instance, impregnation, wiping, injecting or coating. The treated felt can be more stable than conventional felts, whereby the felt is not compressed permanently, but retains its shape and permeability for a long time. When in use, i.e. when being wet, the felt can behave elastically in the press nip, in which case it can also dampen vibrations.

An essential idea of an embodiment of the invention is that the felt is impregnated with a compacting material throughout the whole structure, i.e. from the first outer surface of the felt to its second outer surface.

An essential idea of an embodiment of the invention is using in the coating and/or filling of the press felt a polymer which can be polyurethane, polycarbonate urethane, polyacrylate, a mixture of these materials or another polymer suitable for the purpose. Alternatively, one of the following resin materials is used; acrylic resin, epoxy resin, phenolic resin or a mixture thereof.

An essential idea of an embodiment of the invention is that at least the felt surface on the web side has been ground smooth after the compacting treatment.

An essential idea of an embodiment of the invention is that at least the first and/or second press nip of the press section of a paper machine comprises a press felt treated according to the invention.

An essential idea of an embodiment of the invention is that the press section comprises several successive press nips. The second press nip from the input end of the press section is a smooth-surfaced treated felt according to the invention, while the rest of the press units have a conventional felt.

An essential idea of an embodiment of the invention is that the fibre web is liquid pack board.

An essential idea of an embodiment of the invention is that the fibre web is fine paper.

An essential idea of an embodiment of the invention is that a press felt with seams is formed, at least on the web-side surface of which a coating layer is formed of a polymer material, such as resin. Thus, marking due to yarns that form seam loops can be significantly reduced.

An essential idea of an embodiment of the invention is that a substantially similar press felt treated in the manner according to the invention is arranged in the same press section both in the place of a conventional pick-up felt at the input end of the press section and in a typical transfer belt position at the final end of the press section. It has been observed that higher solid matter content can be achieved when there is a felt participating in the water removal also at the final end of the press section.

The felt according to the invention allows improvement in the runnability of a paper machine, because the cross-machine permeability profile remains uniform more easily than previously. Furthermore, the runnability is improved by the felt having a longer lifetime, whereby felts need not be changed that often and there are less adjusting problems.

A felt according to the invention can be arranged in a press nip having problems relating to changing properties during use, typical for conventional felts. Replacing the conventional felt with a felt according to the invention allows improvement in the runnability.

BRIEF DESCRIPTION OF THE FIGURES

The invention will now be described in more detail with reference to the attached drawings, of which

For the sake of clarity, the invention is shown in a simplified manner in the figures. Similar parts are indicated with the same reference numerals in different figures.

DETAILED DESCRIPTION OF THE INVENTION

Figure 1:
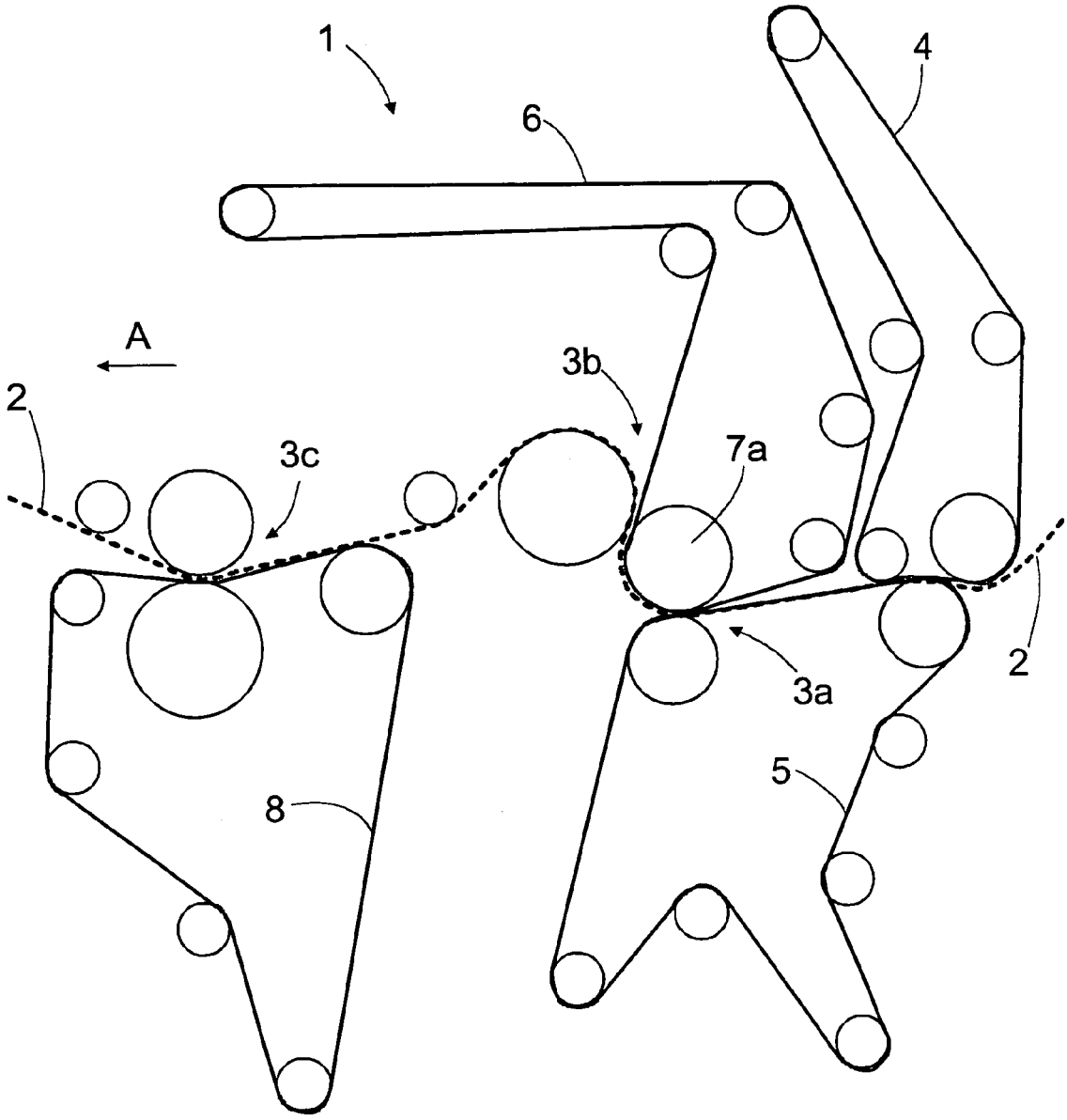
FIGS. 1 to 3 show schematic side views of press sections of a paper machine according to the invention.

FIG. 1 shows a press section 1 of a paper machine. In this case, it is a press section used in manufacturing liquid pack board. The press section 1 can comprise one or more press nips. Seen from direction of travel A of a fibre web 2, the press section 1 according to FIG. 1 comprises a first press nip 3*a*, a second press nip 3*b* and a third press nip 3*c*. The number of press nips can be selected for instance taking into account the fibre web 2 to be treated. In the press section 1 according to the figure, the first felt is what is called a pick-up felt 4, which receives the fibre web 2 from the wire section. After this, the fibre web 2 is supported from below by means of a second felt 5 and from above by means of a third felt 6, supported by which it moves to a first nip 3*a* and further to a second nip 3*b* through a press roll 7*a*. Further, there is a fourth felt 8 in the section of a third nip 3*c*. The fibre web 2 exits the third nip 3*c* to the drying section of the paper machine. In practice, good test results have been obtained when a press felt treated according to the invention has been used as the third felt 6, i.e. in the first and the second nip. In the tests performed, liquid pack board was run, and the results showed that a very high surface quality was achieved.

Figure 2:
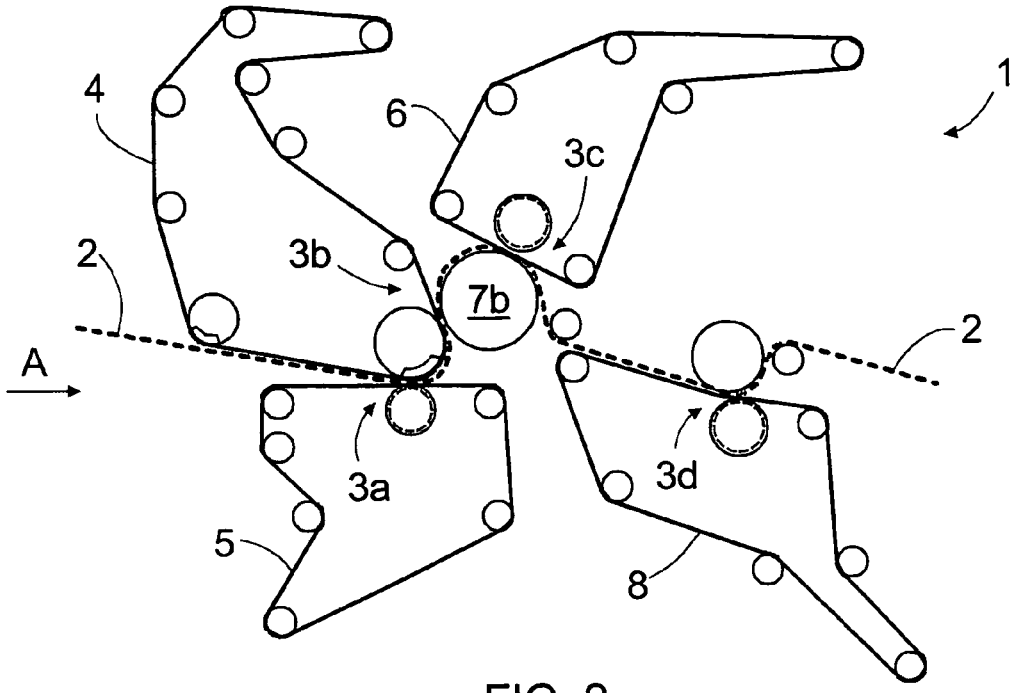

In FIG. 2, the fibre web 2 is run in direction A to the first felt, i.e. pick-up felt 4, and to the second felt 5, between which the web travels to the first press nip 3*a*. Further, the felt 4 supports the web in the second press nip 3*b*. The third felt 6, in turn, participates in the water removal together with an intermediate roll 7*b* in the third nip 3*c*. Furthermore, the press section 1 can, in some cases, comprise a fourth press nip 3*d*, i.e. a separate press, in the section of which there is the fourth felt 8. Any of these four felts 4, 5, 6, 8 can be a press felt treated according to the invention.

With the so-called separate press 3*d* shown in the solution of FIG. 2, the smoothness of the second surface side of the paper can be improved, and thus also the one-sided surface quality caused in preceding positions of the press section can be alleviated. When the felt 8 according to the invention is used in the separate press, the runnability of the felt may be better. This is because, for example, the felt 8 treated according to the invention carries less air with it than a conventional felt, which reduces what is called blowing. Further, between the felt 8 according to the invention and the paper web, adhesive forces may be generated which improve the runnability. Adhesive forces are generated because, for instance, the surface of the felt 8 may be treated to be relatively smooth. Further, adhesive forces are generated because a moisture film may be formed on the surface of the felt 8 due to the felt surface being relatively smooth and the surface structure of the felt being compacted.

Figure 3:
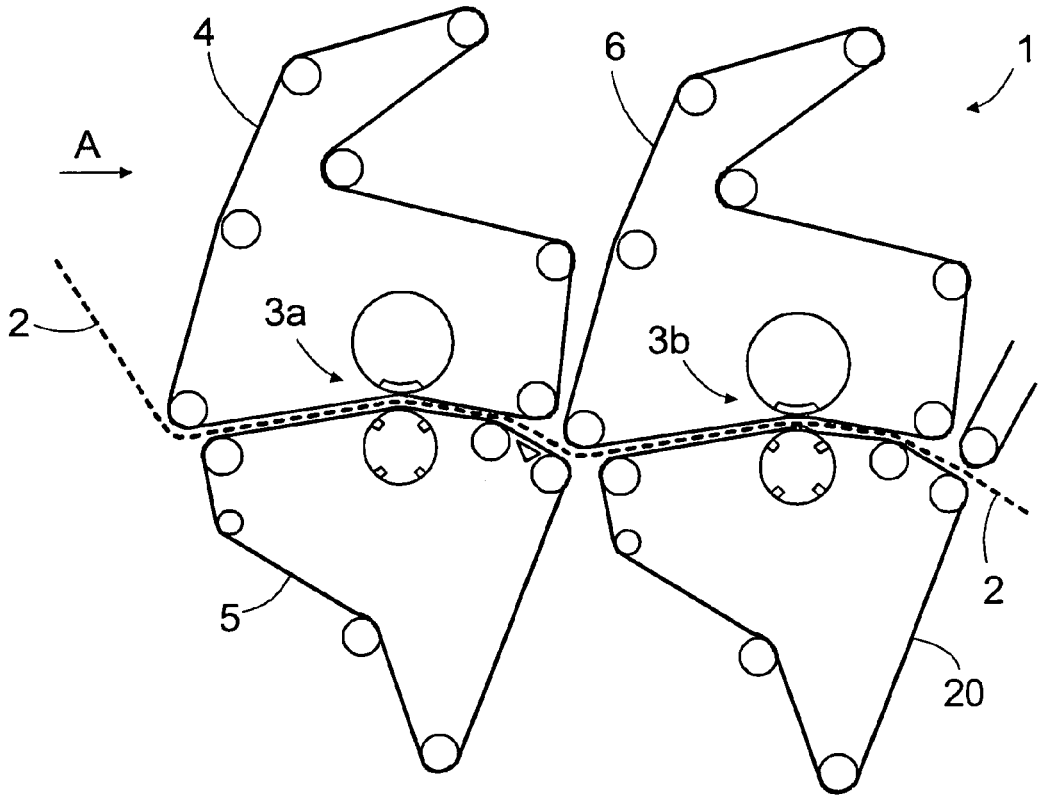

FIG. 3 shows a press felt 1 having two press nips 3*a* and 3*b*, a pick-up felt 4 and a second felt 5, a third felt 6 and a fourth felt 20. Usually, an impermeable transfer belt is used instead of the felt 20 in this position of the press section of this kind. Now, however, a permeable press felt 20 according to the invention is arranged in this position. The permeable press felt 20 forms a slightly felt-like surface in the paper web, whereby one-sided quality of the paper web surface can be prevented. When a press felt according to the invention was mounted in what is called a transfer belt position in the above manner, it was noted that significantly higher solid matter content in the paper web could be achieved in the press section than previously when impermeable transfer belts were used. Further, in the press section according to FIG. 3, also any of the other felts 4, 5, 6 and/or 8 can be a permeable press felt according to the invention.

Figure 4:
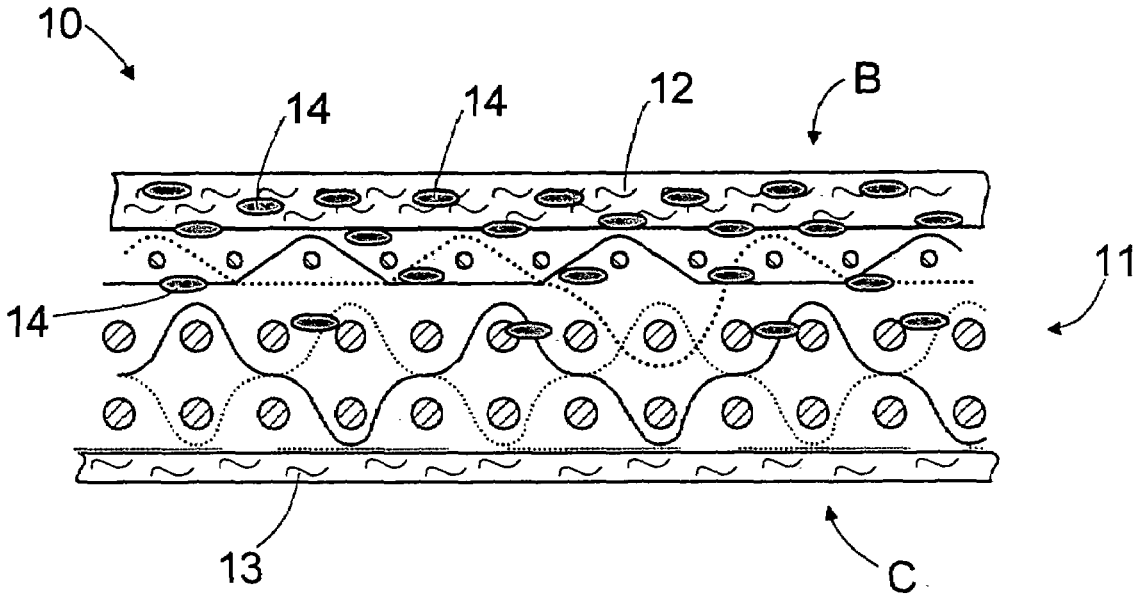
FIGS. 4 to 5 show schematic cross-sections of press felts according to the invention.
Figure 5:
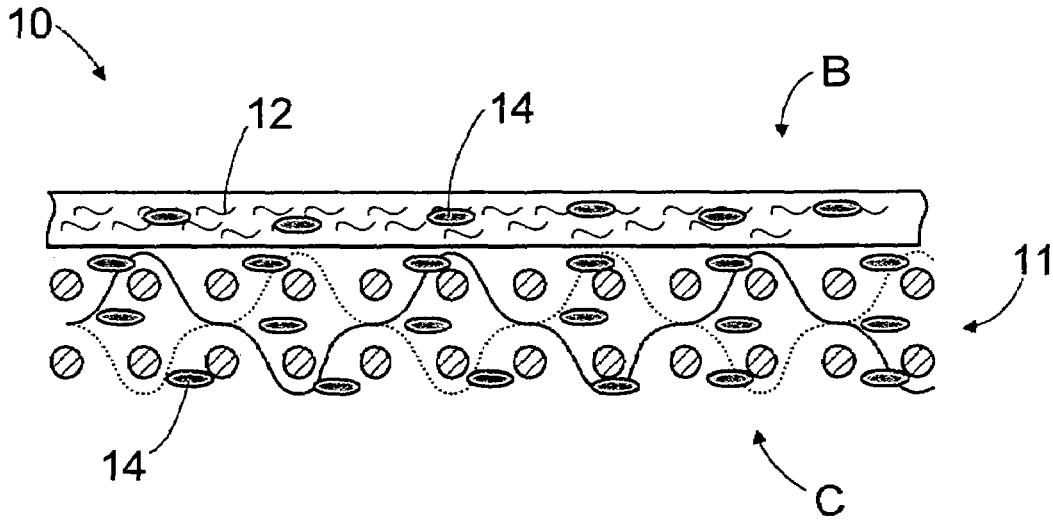

FIG. 4 shows a cross-section of a press felt 10 according to the invention. The felt 10 comprises a base structure 11, which can be a one-layer or multi-layer structure woven of longitudinal and transverse yarns, a non-woven structure, a wound structure, a knitted fabric or any other supportive fabric suitable for the purpose. Batt fibre layers 12 and 13 are arranged on both surfaces of the base structure 11, for instance by needling. At least on the web-side surface B, there is a batt fibre layer 12. By contrast, the batt fibre layer 13 of the backside is not always necessary, as can be seen from FIG. 5. In FIG. 4, a filling material 14 is arranged on the web-side surface B in such a way that the filling material 14 extends over a distance from surface B to the inside of the structure. In FIG. 5, the filling material 14 is arranged throughout the whole felt structure from surface B to the backside. The felts of both FIG. 4 and FIG. 5 have been ground smooth on the side of surface B after the treatment with filling material, whereby the batt fibres form permeable channels in the structure. In addition, the grinding ensures a smooth surface on the web-side surface B. Also combinations of above solutions are feasible.

The press felt can be manufactured as a piece shaped as a closed loop. Alternatively, the felt can be a planar piece, at two edges of which there are jointing loops formed by monofilaments. The jointing loops can, when arranged to intermesh, form a seam loop channel, in which a seam yarn can be arranged to interconnect the felt ends in such a way that a closed-loop piece is formed. Typically, a problem with a felt with seams has been that the yarns forming seam loops must, in practice, be selected to be rather thick, and they must be monofilaments, whereby the yarns forming seam loops have easily caused marking through the batt fibre layer. Further, attachment of the batt fibres to thick monofilament yarns has been poor. Now, marking can be prevented as at least the web-side surface of the felt with seams has been treated with a polymer, such as resin or the like. The treatment can make the felt structure more rigid, which reduces marking due to the seam. In addition, marking can be reduced due to the polymer or the like treatment attaching the batt fibres firmly to the press felt, whereby the batt fibres are more durable than previously and protect the seam area longer. Further, since the press felt is polymer-treated according to the invention completely, no discontinuity point is formed in the seam area due to the treatment. It is further to be noted that the felt with seams can be arranged in any press nip or press position in the press section.

There are also situations where such weave structures or yarns must be used that easily cause marking despite the batt fibre layer. Also in such a case a treatment according to the invention contributes to avoiding marking.

An advantage of a press felt according to the invention is that the polymer treatment of the felt surface attaches the batt fibres firmly to the base structure in such a way that disturbances caused by its detachment can be avoided. For instance in what are called supercalenders, i.e. SC machines, detachment of batt fibres is nowadays a significant problem, which causes marking in the calender and thus also quality errors in the paper web. In addition, a batt fibre stuck to the paper web can cause significant problems in further processing stages of paper, particularly in printing of paper, where a batt fibre can clog and damage sensitive printing machines. Further, a detaching batt fibre can even damage an SC calender. There have been attempts to solve the problem of detaching batt fibres, long known in the field, by using bi-component batt fibres/yarns in the press felt, but no satisfactory solution has been found by merely using bi-component batt fibres and/or yarns.

It is also advantageous to use a felt treated according to the invention as a pick-up felt, because a uniform cross-machine profile is achieved with it. The edges are important in a pick-up felt. The permeability of a pick-up felt can be easily dimensioned greater than that of the felts used in other positions.

A felt according to the invention can be produced by impregnating, for instance. Thus, the base structure of the press felt is formed first, after which the required batt fibre layers are attached to the base structure. Subsequently, at least the web-side surface of the felt is treated with a water dispersion consisting of a polymer and possible additional chemicals. The impregnation is done in such a way that the desired permeability is achieved. The permeability of the final product can be affected by the selection of the base structure, the batt fibre, and further by changing the extent of the polymer treatment and the amount of polymer material used for the treatment. After the impregnation, the felt is dried, after which the polymer is crosslinked. For example heat, chemical or irradiation can be used for crosslinking the polymer. Ultraviolet light, electron irradiation or IR light, for example, can be used for the irradiation. In the polymer treatment, for instance polyurethane, polycarbonate urethane, polyacrylate, a mixture thereof or another polymer suitable for the purpose can be used. When the felt has been hardened and cooled, it is finished by grinding at least its web-side surface smooth. Grinding paper can be used for the grinding. The fineness of the grinding paper can be selected according to how smooth a surface is desired for the press felt each particular time. The fineness of the grinding paper can thus be for instance 100, 180, 240 or 360. The surface roughness $R_z$ of the press felt can be at least 20 μm. Preferably, $R_z$ is between 20 to 100 μm. In some cases, the grinding is not quite necessary if the desired surface smoothness is obtained in another way. The surface smoothness of the press felt can be affected at least by the selection of the base fabric and the batt fibre, the extent of the polymer treatment and the polymer used for the treatment. Further, the press felt can be calendered to obtain a smooth surface. The polymer treatment can be performed by injecting or wiping instead of the above-mentioned impregnation.

With grinding, suitable smoothness and the right micro roughness are achieved for the felt surface. Micro roughness can be adjusted not only with the roughness of the grinding means but also with the fineness of the batt fibres. The fibre material can vary depending on the object of use and the fibre web to be treated. The roughness of the batt fibre can be 3.1 to 100 dtex, or the fibres can be microfibres of even below 2 dtex. There may be fibres of either one or more finenesses, the length of the fibres being typically 10 to 150 mm before the needling. The fibres can have round, flat or angular profiles. Further, the fibres can be coated, for example polyamide fibres coated with a copolyamide.

In the invention, one or more polymer materials can form a mixture with a liquid. Thus, the polymer treatment can be carried out with a dispersion of polymer and water, for instance. Also liquids other than water can be used. When the water or other liquid is removed from the press felt after the polymer treatment, pores are formed in the press felt. These pores are formed when space is released as a result of liquid removal. Owing to the pores, the press felt can receive water from the fibre web.

Figure 6:
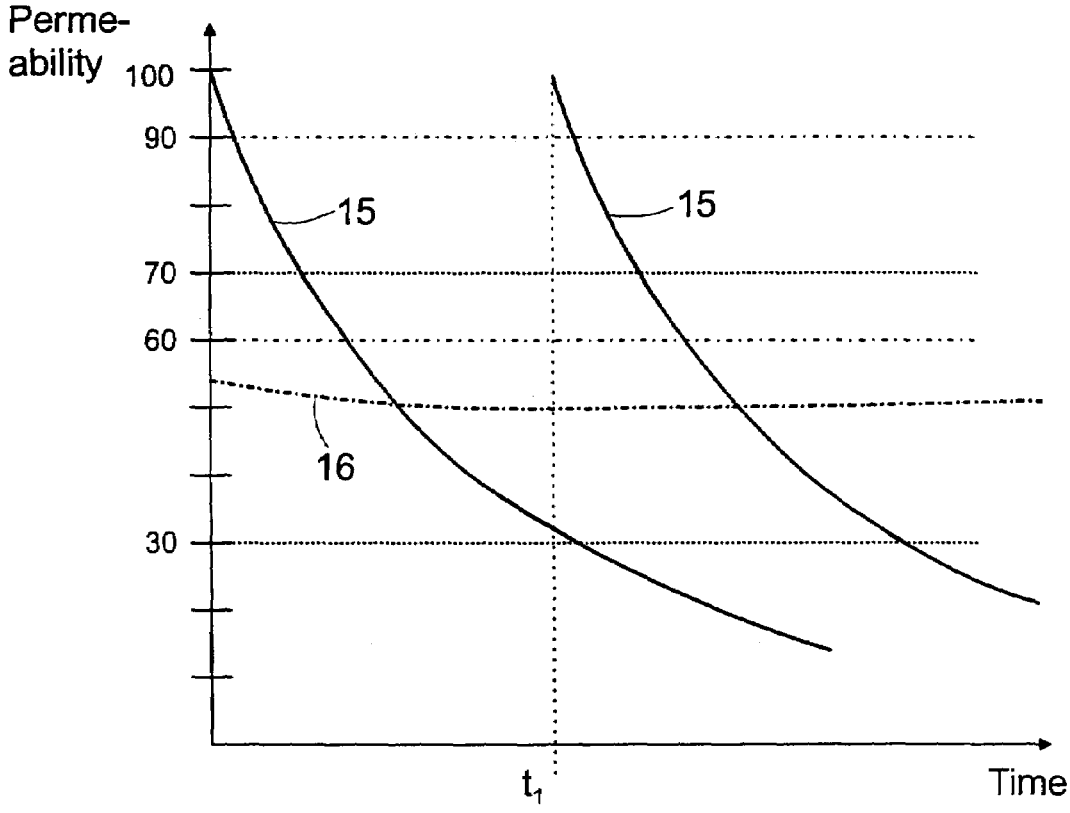
FIG. 6 shows schematically the permeability of a conventional press felt and a press felt according to the invention as a function of time.

In FIG. 6, curves 15 show the permeability of a conventional felt as a function of time and correspondingly, curve 16 shows the permeability of a felt according to the invention as a function of time. As can be seen from FIG. 6, the conventional felts have at the beginning clearly higher permeability, which, however, decreases quickly in use. By contrast, the felt according to the invention can, even as new, have permeability of 70 to 30 of the relative permeability value 100 of a conventional felt. A surprising phenomenon in the felt according to the invention is, however, that the permeability remains significantly constant during the whole lifetime of the felt, as can also be seen from the figure. In practice, conventional felts must be changed at a moment of time $t_1$, whereas with a felt according to the invention, running can be continued. Changing felts always results in an interruption in the production. In addition, running parameters of the paper machine must typically be adjusted for some time before the normal production run can start after the change. All this causes production losses and running problems.

Adjusting the treatment according to the invention allows formation of press felts in different positions of the press section. The permeability value of the pick-up felt used at the input end of the press section can be set between 90 and 60 of the relative permeability value 100 of a conventional felt. A pick-up felt has thus a relatively high permeability, and therefore removes water efficiently. In positions where the amount of water to be removed is smaller and where one of the important characteristics of the felt is good runnability, a press felt can be used which has been subjected to a more complete treatment than a pick-up felt. Permeability of such a felt can be between 60 and 30 of the relative permeability value 100 of a conventional felt.

With press felts according to the invention, following permeability values are obtained: the air permeability of a pick-up felt is usually more than 6 $m^3/M^2$min, 100 Pa, even between 10 and 30 $m^3/m^2$min, 100 Pa. In the third and fourth nip of the press section, a press felt can be used the permeability of which is 4 to 15 $m^3/m^2$min, 100 Pa. Further, in the press of FIG. 3, the permeability of the felt 20 can be 2 to 6 $m^3/m^2$min, 100 Pa.

Figure 7:
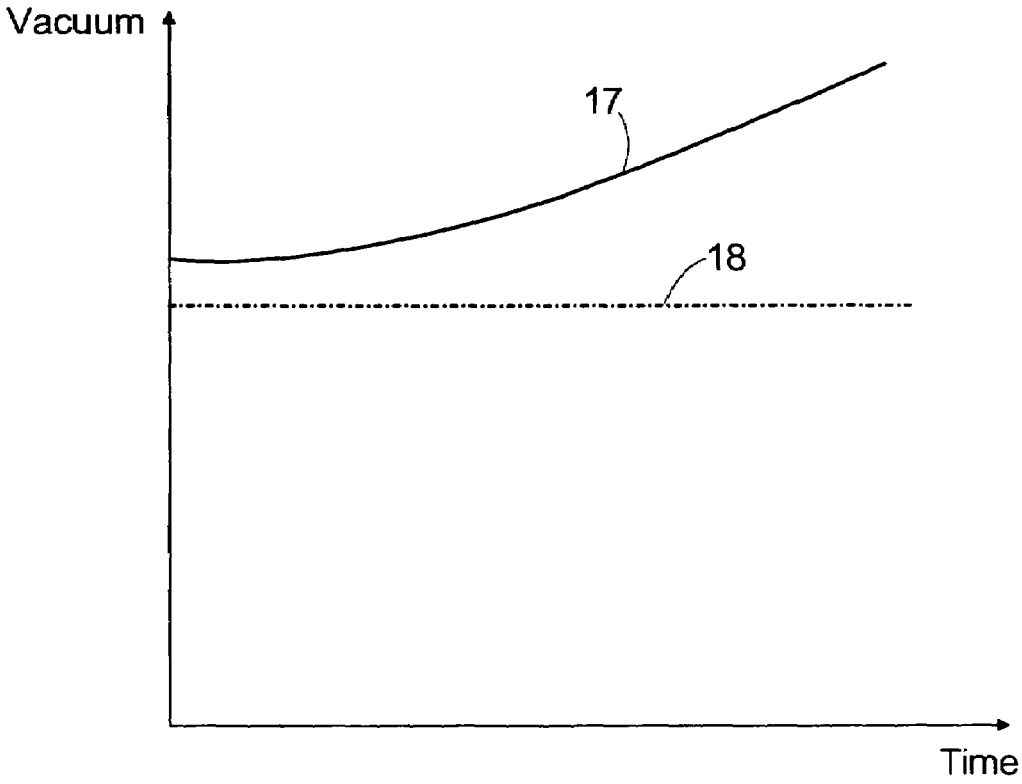
FIG. 7 shows schematically, as a function of time, a vacuum required for conditioning a conventional press felt and a press felt according to the invention.
Figure 8:
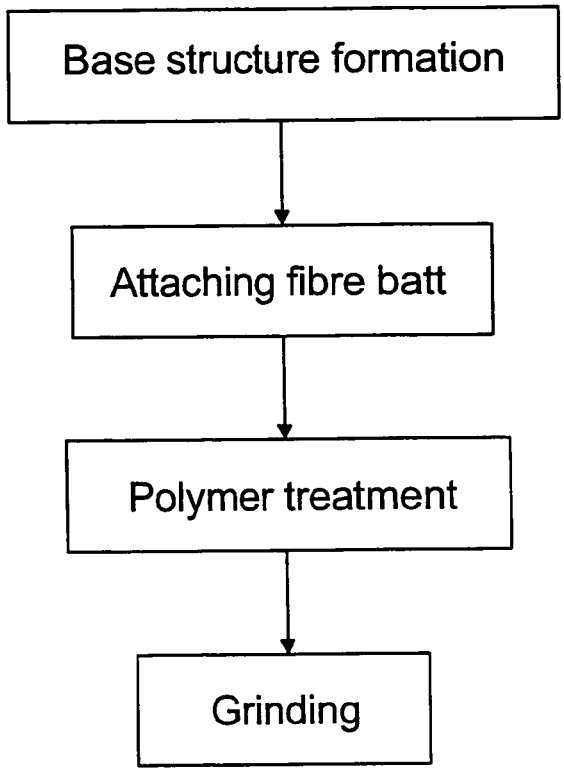
FIG. 8 shows schematically the steps of a manufacturing method of a press felt according to the invention.

FIG. 7 shows, as a function of time, the vacuum used in conditioning the felt. In connection with the return passage of the felt, there are typically one or more suction boxes, in which the felt is subjected to what is called conditioning, in other words water and dirt that has stuck to it are removed from it. A vacuum is used for the conditioning. As can be seen from the figures, the uhle box vacuum of the conditioning increases as a function of time with a conventional felt, whereas with a felt according to the invention the need for a vacuum remains substantially constant, as indicated by curve 18. In this way, the felt according to the invention also improves the runnability of the press section, because now the vacuum of the conditioning needs not be controlled continuously.

Yet another advantage of the invention is quick start-up. Conventional press felts must be at first run at a lower speed in the press section, so that their structure can be compacted together and made appropriately compact. A press felt according to the invention, by contrast, has a more compact structure as early as after the manufacture. The polymer material has clogged parts of the felt structure, so that there is only a little excess space in it, and therefore, the felt needs not be compacted together in the press section before the start-up. In addition, the elastic structure of the press felt according to the invention contributes to quick start-up. The quick startability of the felt has been observed in all positions of the press section.

Figure 9:
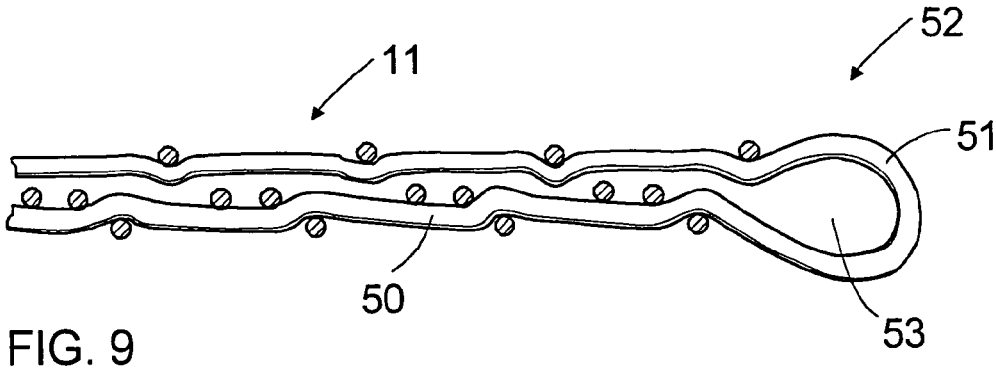
FIG. 9 shows schematically a base structure of a press felt provided with a seam loop.

FIG. 9 shows a base structure of a press felt, provided with seam loops 51 formed of longitudinal yarns 50. The seam loops 51 are formed at opposite transverse edges 52 of the press felt. The press felt can be connected to form a closed-loop shape by arranging the seam loops of the opposite edges 52 intermeshed, whereby a seam loop channel 53 is formed, in which a seam yarn 54 can be arranged.

Figure 10:
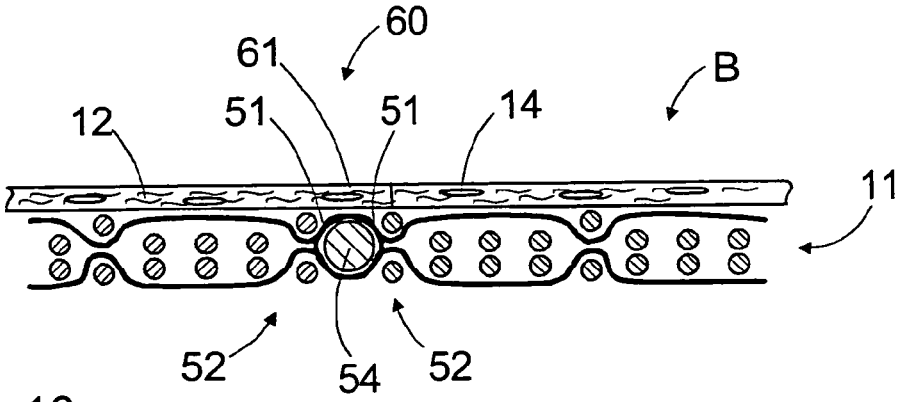
FIG. 10 shows schematically a seam area of a press felt according to the invention.

FIG. 10 shows a seam area 60 of a press felt according to the invention. The transverse jointing edges 52 of the press felt are interconnected with the seam yarn 54, whereby the press felt is of a closed-loop shape. The seam area 60 is protected by a seam flap 61 comprising batt fibres 12. The batt fibres 12 have been needled into the base structure 11 and additionally attached by means of the polymer material 14. The polymer treatment thus improves the durability of the seam flap 61. Furthermore, the polymer material 14 makes the seam flap 61 more rigid, whereby it gives good protection to the seam area 60.

The drawings and the related specification are only intended to illustrate the idea of the invention. The details of the invention can vary within the claims.

What is claimed is:

1. A press felt comprising at least:

a base structure having at least a first surface on a fiber-web side and an opposite second surface, and at least one batt fiber layer attached to at least the first surface of the base structure to form a web-side surface of the press felt, and wherein at least the web-side surface of the press felt is impregnated with a dispersion of one or more polymer materials and water for compacting the structure of the press felt and for additionally attaching the batt fiber layer;

the structure of the press felt is porous for receiving water, the air permeability being at least 2 $m^3/m^2$min, 100 Pa, and at least the web-side surface of the press felt is ground smooth after the compacting.

2. A press felt according to claim 1, wherein one of the following polymer materials or mixtures thereof is used for compacting the structure of the press felt: polyurethane, polycarbonate urethane, polyacrylate, acryl resin, epoxy resin, phenolic resin.

3. A press felt according to claim 1, wherein the air permeability of the press felt is 2 to 30 $m^3/m^2$min, 100 Pa.

4. A press felt according to claim 1, wherein the air permeability of the press felt is at least 6 $m^3/m^2$min, 100 Pa.

5. A press felt according to claim 4, wherein the press felt is a pick-up felt and the structure of the press felt is compacted by the one or more polymer materials in such a way that its air permeability is 6 to 30 $m^3/m^2$min, 100 Pa.

6. A press felt according to claim 3, wherein the structure of the press felt is compacted by the one or more polymer materials in such a way that its air permeability is 2 to 6 $m^3/m^2$min, 100 Pa.

7. A press felt according to claim 1, wherein the press felt is impregnated with a dispersion of one or more polymer materials and water throughout the whole structure from a first outer surface to a second outer surface.

8. A press felt according to claim 1, wherein the web-side surface of the press felt includes batt fibers and polymer material after being ground.

9. A press felt according to claim 1, wherein pores are formed in the press felt when space is released as a result of water removal caused by a drying, and wherein the pores in the press felt are capable of receiving water from a fiber web during pressing carried out in a press nip.

10. The press felt of claim 1, wherein the web-side surface of the press felt is ground smooth to a surface roughness of at least 20 μm.

11. The press felt of claim 1, wherein the web-side surface of the press felt is ground smooth to a surface roughness of from about 20 μm to about 100 μm.

12. A method of manufacturing a press felt, comprising:

forming a base structure having a first surface on a fiber-web side and an opposite second surface, attaching at least one batt fiber layer to at least the side of the first surface of the base structure to form a web-side surface of the press felt, treating at least the web-side surface of the press felt with one or more polymer materials for compacting the structure of the press felt in such a way that the air permeability of the press felt is at least 2 $m^3/m^2$min, 100 Pa, whereby, after the treatment, the structure is more dense than before the treatment, yet comprising pores to receive water;

wherein the polymer treatment is used for additionally attaching the batt fiber layer to the base structure; and wherein the polymer treatment comprises the following steps:

impregnating at least the web-side surface of the press felt with a dispersion of one or more polymer materials and water;

drying the press felt after the dispersion treatment; and hardening the polymer material brought to the press felt, and further;

grinding, after the compacting treatment, at least the web-side surface of the press felt to achieve a smoother surface.

13. A method according to claim 12, comprising using one of the following polymer materials or mixtures thereof for compacting the structure of the press felt: polyurethane, polycarbonate urethane, polyacrylate, acryl resin, epoxy resin, phenolic resin.

14. A method according to claim 12, comprising compacting the structure of the press felt by the polymer treatment in such a way that its air permeability is 2 to 30 $m^3/m^2$min, 100 Pa.

15. A method according to claim 14, comprising compacting the structure of the press felt by the polymer material in such a way that its air permeability is 6 to 30 $m^3/m^2$min, 100 Pa.

16. A method according to claim 14, comprising compacting the structure of the press felt by the polymer material in such a way that its air permeability is 2 to 6 $m^3/m^2$min, 100 Pa.

17. A method according to claim 12, comprising: impregnating the press felt with a dispersion of one or more polymer materials and water throughout the whole structure from a first outer surface to a second outer surface.

18. A method according to claim 12, comprising: grinding, after the compacting treatment, the web-side surface of the press felt so that batt fibers are exposed, whereby the baff fibers form permeable channels in the web-side surface.

19. A method according to claim 12, comprising: removing water from the press felt during the drying and forming pores in the press felt, which pores are capable of receiving water from a fiber web during pressing carried out in a press nip.

20. A press section of a paper machine having several successive press positions, each of the press positions comprising at least one press nip in which a fiber web to be dried is supported by means of at least one press felt, and wherein at least one press position is provided with a press felt impregnated with one or more polymer materials; the air permeability of the press felt treated with the one or more polymers is at least 2 $m^3/m^2$min, 100 Pa and maximum 30 $m^3/m^2$min, 100 Pa; and the press felt treated with the polymer is arranged to receive water from the fiber web during the pressing carried out in the press nip.

21. A press section according to claim 20, wherein the press felt is impregnated with a dispersion of one or more polymer materials and water throughout the whole structure from a first outer surface to a second outer surface.

22. A press section according to claim 20, wherein at least one press section is provided with a press felt the web-side surface of which has been ground so that batt fibers are exposed, and wherein the web-side surface of the press felt includes baff fibers and polymer material after being ground.

23. A press section of a paper machine having several successive press positions, each of the press positions comprising at least one press nip in which a fiber web to be dried is supported by means of at least one press felt, and wherein at least one press position is provided with a press felt impregnated with one or more polymer materials; the air permeability of the press felt treated with the one or more polymers is at least 2 $m^3/m^2$min, 100 Pa; and the press felt treated with the polymer is arranged to receive water from the fiber web during the pressing carried out in the press nip, wherein at least one press position is provided with a press felt the web-side surface of which has been ground smooth, whereby the smooth-surfaced felt is arranged to smooth the surface of the fiber web.

24. A press section of a paper machine having several successive press positions, each of the press positions comprising at least one press nip in which a fiber web to be dried is supported by means of at least one press felt, and wherein at least one press position is provided with a press felt impregnated with one or more polymer materials; the air permeability of the press felt treated with the one or more polymers is at least 2 $m^3/m^2$min, 100 Pa; and the press felt treated with the polymer is arranged to receive water from the fiber web during the pressing carried out in the press nip, wherein the first press position of the press section is provided with a pick-up felt compacted with one or more polymers, the air permeability of the pick-up felt being 6 to 30 $m^3/m^2$min, 100 Pa.

25. A press section of a paper machine having several successive press positions, each of the press positions comprising at least one press nip in which a fiber web to be dried is supported by means of at least one press felt, and wherein at least one press position is provided with a press felt impregnated with one or more polymer materials; the air permeability of the press felt treated with the one or more polymers is at least 2 $m^3/m^2$min, 100 Pa; and the press felt treated with the polymer is arranged to receive water from the fiber web during the pressing carried out in the press nip, wherein the last press position of the press section is provided with a press felt compacted with the one or more polymers, the air permeability of the press felt being 2 to 6 $m^3/m^2$min, 100 Pa.

26. A press section of a paper machine having several successive press positions, each of the press positions comprising at least one press nip in which a fiber web to be dried is supported by means of at least one press felt, and wherein at least one press position is provided with a press felt impregnated with one or more polymer materials; the air permeability of the press felt treated with the one or more polymers is at least 2 $m^3/m^2$min, 100 Pa; and the press felt treated with the polymer is arranged to receive water from the fiber web during the pressing carried out in the press nip, wherein the press section comprises a separate press and that the separate press has a press felt the air permeability of which is 5 to 10 $m^3/m^2$min, 100 Pa.

27. A press section of a paper machine having several successive press positions, each of the press positions comprising at least one press nip in which a fiber web to be dried is supported by means of at least one press felt, and wherein at least one press position is provided with a press felt impregnated with one or more polymer materials; the air permeability of the press felt treated with the one or more polymers is at least 2 $m^3/m^2$min, 100 Pa; and the press felt treated with the polymer is arranged to receive water from the fiber web during the pressing carried out in the press nip, wherein all press positions of the press section are provided with press felts compacted by the one or more polymers.

28. A press felt with seams, comprising at least:

a base structure which is formed of longitudinal yarns and transverse yarns, and which base structure has a first surface on a fiber-web side and an opposite second surface;

a first transverse jointing edge and a second transverse jointing edge of the base structure, which jointing edges have seam loops formed by the longitudinal yarns of the base structure for interconnecting the jointing edges; and at least one batt fiber layer attached to at least the first surface of the base structure to form a web-side surface of the press felt, at least the web-side surface of the press felt being impregnated with a dispersion of one or more polymer materials and water for compacting the structure of the press felt and for additionally attaching the batt fiber layer; and wherein the structure of the press felt is porous for receiving water, the air permeability being at least 2 $m^3/m^2$min, 100 Pa.

29. A press felt with seams according to claim 28, wherein the press felt is impregnated with a dispersion of one or more polymer materials and water throughout the whole structure from a first outer surface to a second outer surface.

30. A press felt with seams according to claim 28, wherein the web-side surface of the press felt has been ground so that batt fibers are exposed, and wherein the web-side surface of the press felt includes batt fibers and polymer material after being ground.

31. A press section of a paper machine having several successive press positions, each of the press positions comprising at least one press nip in which a fiber web to be dried is supported by means of at least one press felt, and wherein at least one press position is provided with a press felt impregnated with one or more polymer materials; the air permeability of the press felt treated with the one or more polymers is at least 2 $m^3/m^2$min, 100 Pa; and the press felt treated with the polymer is arranged to receive water from the fiber web during the pressing carried out in the press nip, wherein pores are formed in the press felt when space is released as a result of water removal caused by a drying, and wherein the pores in the press felt are thereby capable of receiving water from a fiber web during pressing carried out in a press nip.

32. A press felt with seams, comprising at least:

a base structure which is formed of longitudinal yarns and transverse yarns, and which base structure has a first surface on a fiber-web side and an opposite second surface;

a first transverse jointing edge and a second transverse jointing edge of the base structure, which jointing edges have seam loops formed by the longitudinal yarns of the base structure for interconnecting the jointing edges; and at least one batt fiber layer attached to at least the first surface of the base structure to form a web-side surface of the press felt, at least the web-side surface of the press felt being impregnated with a dispersion of one or more polymer materials and water for compacting the structure of the press felt and for additionally attaching the batt fiber layer;

wherein the structure of the press felt is porous for receiving water, the air permeability being at least 2 $m^3/m^2$min, 100 Pa; and wherein pores are formed in the press felt when space is released as a result of water removal caused by a drying, and wherein the pores in the press felt are thereby capable of receiving water from a fiber web during pressing carried out in a press nip.

* * * * *